US011221136B2

(12) United States Patent
Schalles

(10) Patent No.: US 11,221,136 B2
(45) Date of Patent: Jan. 11, 2022

(54) SYSTEM AND METHOD FOR OPTIMIZING BURNER UNIFORMITY AND NOX

(71) Applicant: Bloom Engineering Company, Inc., Pittsburgh, PA (US)

(72) Inventor: David G. Schalles, Jefferson Hills, PA (US)

(73) Assignee: Bloom Engineering Company Inc., Pittsburgh, PA (US)

( * ) Notice: Subject to any disclaimer, the term of this patent is extended or adjusted under 35 U.S.C. 154(b) by 20 days.

(21) Appl. No.: 16/609,534

(22) PCT Filed: May 25, 2018

(86) PCT No.: PCT/US2018/034633
§ 371 (c)(1),
(2) Date: Oct. 30, 2019

(87) PCT Pub. No.: WO2018/218141
PCT Pub. Date: Nov. 29, 2018

(65) Prior Publication Data

US 2020/0072459 A1 Mar. 5, 2020

Related U.S. Application Data

(60) Provisional application No. 62/511,533, filed on May 26, 2017.

(51) Int. Cl.
*F23C 7/02* (2006.01)

(52) U.S. Cl.
CPC ..... *F23C 7/02* (2013.01); *F23C 2201/20* (2013.01); *F23C 2900/06041* (2013.01)

(58) Field of Classification Search
CPC ..... A01K 1/0047; A01K 1/0052; F23C 7/02; F23C 2900/06041
(Continued)

(56) References Cited

U.S. PATENT DOCUMENTS 3,736,747 A * 6/1973 Warren ..... F23R 3/04 60/732
4,181,491 A 1/1980 Hovis
(Continued)

FOREIGN PATENT DOCUMENTS

| | | | |
|---|---|---|---|
| EP | 1634856 | A1 | 3/2006 |
| GB | 2442861 | A | 4/2008 |
| KR | 1020100051548 | A | 5/2010 |

OTHER PUBLICATIONS https://www.nrel.gov/docs/fy02osti/31496.pdf, hereinafter "Energy Tips".*

(Continued)

*Primary Examiner* — Vivek K Shirsat
(74) *Attorney, Agent, or Firm* — The Webb Law Firm

(57) ABSTRACT

A method of operating a combustion burner to heat a furnace. Fuel and combustion air are supplied into a combustion zone and ignited. Additional combustion air is supplied into the atmosphere outside of the combustion zone. The amount of additional combustion air supplied outside of the combustion zone is decreased as a temperature of the atmosphere inside the furnace increases such that the content of nitrogen oxides (NOx), as corrected for 3% $O_2$ (cNOx (3% $O_2$)), in the gases generated by combustion of the fuel and the combustion air and emitted from the furnace maintained below a predetermined value.

16 Claims, 4 Drawing Sheets

(58) Field of Classification Search
USPC ..... 431/8; 119/448, 500, 493
See application file for complete search history.

(56) References Cited

U.S. PATENT DOCUMENTS

| | | | | |
|---|---|---|---|---|
| 4,257,763 | A * | 3/1981 | Reed | F23C 6/047 431/174 |
| 5,263,849 | A | 11/1993 | Irwin et al. | |
| 6,000,930 | A | 12/1999 | Kelly et al. | |
| 6,685,463 | B2 | 2/2004 | Finke et al. | |
| 8,475,161 | B2 | 7/2013 | Wünning et al. | |
| 2001/0038985 | A1 | 11/2001 | Finke et al. | |
| 2004/0211345 | A1 | 10/2004 | Okazaki et al. | |
| 2006/0057517 | A1 | 3/2006 | Joshi et al. | |

OTHER PUBLICATIONS

Regulation 62.5, Air Pollution Control Standards. https://www.epa.gov/sites/production/files/2017-12/documents/62.5_-_std_5.2-2017.pdf.*

* cited by examiner

SYSTEM AND METHOD FOR OPTIMIZING BURNER UNIFORMITY AND NOX

CROSS REFERENCE TO RELATED APPLICATIONS

This application is the U.S. national phase of International Application No. PCT/US2018/034633 filed May 25, 2018, and claims priority to the U.S. Provisional Patent Application No. 62/511,533 filed May 26, 2017, the disclosures of which are hereby incorporated by reference in their entirety by.

BACKGROUND OF THE INVENTION

Field of the Invention

The present invention is directed to a combustion burner system for heating a furnace that reduces the formation of nitrogen oxides (NOx) during combustion and provides good temperature uniformity within the furnace.

Description of Related Art

In furnaces for metallurgical heat treatment, combustion burner assemblies that can provide both a low level of nitrogen oxides (NOx) in the products of combustion and good temperature uniformity over a wide range of soaking temperatures are needed. Prior art combustion burners do not provide both of these features. The combustion burner described in U.S. Pat. No. 4,181,491, incorporated herein by reference, includes an additional air jet that can be turned on when the soaking temperature of the furnace is low in order to increase circulation within the furnace, thereby providing good temperature uniformity. However, this combustion burner is operated under stoichiometric combustion conditions and does not provide any NOx reduction. The combustion burner described in U.S. Pat. No. 6,685,436, incorporated herein by reference, provides NOx reduction via air staging and fuel staging, but does not necessarily provide good temperature uniformity.

Current fuel-fired combustion technology for metallurgical heat-treating often relies on operation with excess air for the purpose of improving furnace temperature uniformity. However, excess air operation typically increases the nitrogen oxide (NOx) emissions from combustion. Furthermore, NOx emissions increase in proportion to furnace operating temperature. Additionally, furnace uniformity tends to improve at higher furnace operating temperature, as the dominant mode of heat transfer changes from convective to radiative over the normal operating ranges of such furnaces. The present combustion burner and its method of operation provide both NOx reduction and good temperature uniformity using a control method for the combustion system which can optimize furnace performance by taking these aforementioned phenomena into account.

SUMMARY OF THE INVENTION

The present invention is directed to a method of operating a combustion burner to heat a furnace. Fuel and combustion air are supplied into a combustion zone and ignited. Additional combustion air is supplied into the atmosphere outside of the combustion zone. The amount of additional combustion air supplied outside of the combustion zone is decreased as a temperature of the atmosphere inside the furnace increases such that the content of nitrogen oxides (NOx), as corrected for 3% $O_2$ (cNOx (3% $O_2$)), in the gases generated by combustion of the fuel and the combustion air and emitted from the furnace is maintained below a predetermined value. The predetermined value for cNOx (3% $O_2$) may be 100 ppm or 40 ppm. The fuel may be natural gas and/or the combustion air may be supplied at ambient temperature or may be preheated.

The total amount of combustion air supplied may be in excess of the stoichiometric air requirement for complete combustion. 5-30% excess air above the stoichiometric air requirement for complete combustion may be supplied within the combustion zone, and 4-25% excess air above the stoichiometric air requirement for complete combustion may be supplied as additional combustion air into the atmosphere outside of the combustion zone. The amount of excess air above the stoichiometric air requirement for complete combustion that is supplied may be decreased as the temperature of the atmosphere inside the furnace increases.

As the temperature of the atmosphere inside the furnace increases, the relationship between the amount of additional combustion air supplied outside of the combustion zone and the temperature of the atmosphere inside the furnace may be inverse linear.

The combustion zone may comprise a primary combustion zone and a secondary combustion zone. Primary fuel, secondary fuel, and primary combustion air may be supplied into the primary combustion zone and secondary fuel may be supplied into the secondary combustion zone. A velocity at which the primary fuel is supplied may be less than a velocity at which the secondary fuel is supplied.

The combustion burner may comprise a port block that at least partially defines the combustion zone and the additional combustion air supplied into the atmosphere outside of the combustion zone may be supplied through a passageway provided in the port block. Alternatively, the additional combustion air supplied into the atmosphere outside of the combustion zone may be supplied from a separate unit that is attached near the combustion burner.

A centerline of an air jet supplying the additional combustion air supplied outside of the combustion zone may be parallel to and offset from a centerline of the combustion zone. The additional combustion air supplied into the atmosphere outside of the combustion zone may be supplied at a higher velocity than the combustion air supplied into the combustion zone.

BRIEF DESCRIPTION OF THE DRAWING(S)

Figure 4:
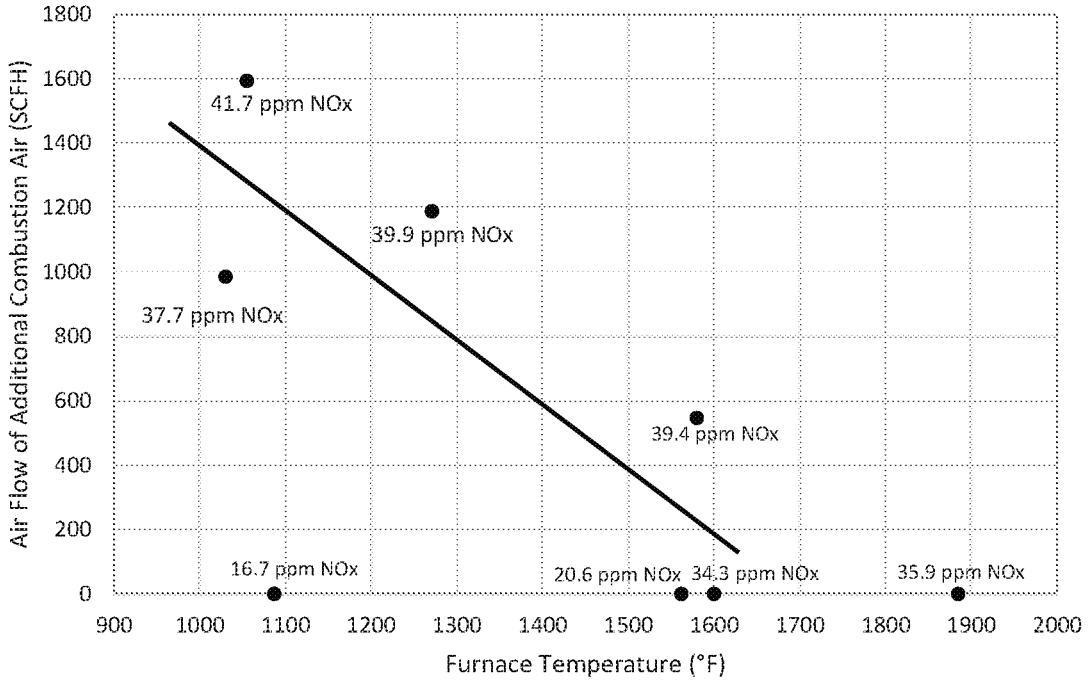
Figure 5:
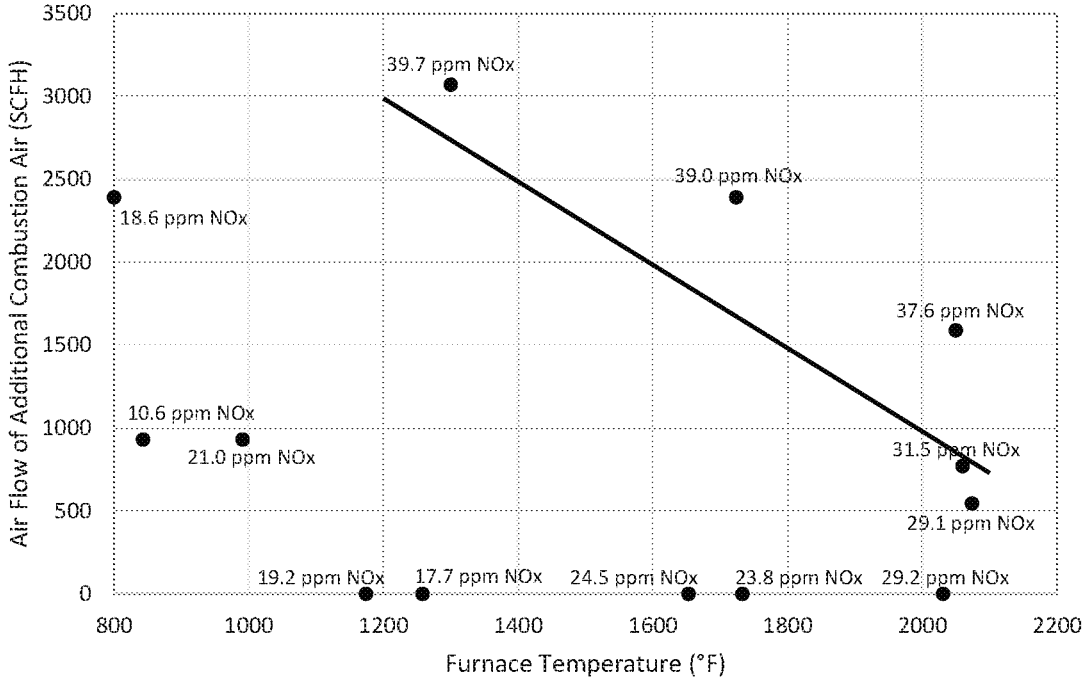

FIG. 4 is a graph showing the relationship between combustion air flow through the air jet, cNOx(3% $O_2$) in the gases generated by combustion of the fuel and the combustion air and emitted from the furnace, and furnace temperature for a combustion burner operated at 40% of maximum firing; and FIG. 5 is a graph showing the relationship between combustion air flow through the air jet, cNOx(3% $O_2$) in the gases generated by combustion of the fuel and the combustion air and emitted from the furnace, and furnace temperature for a combustion burner operated at 100% of maximum firing.

DESCRIPTION OF THE INVENTION

As used herein, unless otherwise expressly specified, all numbers such as those expressing values, ranges, amounts or percentages may be read as if prefaced by the word "about", even if the term does not expressly appear. Any numerical range recited herein is intended to include all sub-ranges subsumed therein. For example, a range of "1 to 10" is intended to include any and all sub-ranges between and including the recited minimum value of 1 and the recited maximum value of 10, that is, all subranges beginning with a minimum value equal to or greater than 1 and ending with a maximum value equal to or less than 10, and all subranges in between, e.g., 1 to 6.3, or 5.5 to 10, or 2.7 to 6.1. Plural encompasses singular and vice versa. When ranges are given, any endpoints of those ranges and/or numbers within those ranges can be combined with the scope of the present invention. "Including", "such as", "for example" and like terms means "including/such as/for example but not limited to".

The present invention is directed to a burner system for heating a furnace chamber and a method of operating the burner system. The burner system comprises a combustion burner and an air jet placed outside of the combustion zone(s) of the combustion burner. The combustion burner and method of operation are adapted to generate less than 100 ppm of nitrogen oxides (NOx), including nitric oxide (NO) and nitrogen dioxide (NO2), as corrected for 3% $O_2$, i.e., a cNOx (3% $O_2$)<100 ppm, in the exhaust gases that exit the furnace. The NOx production may be at least partially controlled by the manner in which the combustion burner is operated and at least partially controlled by the manner in which the air jet placed outside of the combustion zone(s) of the combustion burner is operated.

As used herein, terms such as fuel-lean, fuel-rich, and excess combustion air are used to refer to combustion in which the fuel and/or the combustion air are supplied in non-stoichiometric amounts. Fuel-lean combustion is combustion where the amount of fuel that is supplied is less than the stoichiometric amount required for complete combustion. Fuel-rich combustion is combustion where the amount of fuel that is supplied is more than the stoichiometric amount required for complete combustion. Excess combustion air is an amount of combustion air that is provided in excess of the stoichiometric amount required for complete combustion. As used herein, combustion air includes air, oxygen, and other gases containing oxygen that can support combustion. As used herein, fuel includes gaseous fuels such as natural gas.

The combustion burner may be operated to control the NOx using any suitable method, for example, two-stage combustion using air staging or fuel staging or selective non-catalytic reduction. Two-stage combustion utilizes a fuel-lean combustion zone and a fuel-rich combustion zone to reduce the production of NOx. When air staging is used, the combustion air is separated into primary and secondary flows. The primary combustion air is mixed with the fuel in a primary combustion zone to produce an oxygen-deficient, fuel-rich mixture where sub-stoichiometric combustion conditions and low temperature retard the formation of NOx. The secondary combustion air is injected outside of the primary combustion zone in a secondary combustion zone in order to complete combustion. When fuel staging is used, the fuel is separated into primary and secondary flows. The primary fuel is mixed with the combustion air in a first combustion zone to produce an oxygen-rich, fuel-deficient zone where the relatively low combustion temperature retards the formation of NOx. The secondary fuel is injected into a second combustion zone downstream from the first combustion zone in order to complete combustion. Air staging and fuel staging can be combined as described in U.S. Pat. No. 6,685,463, herein incorporated in its entirety by reference.

Figure 1:
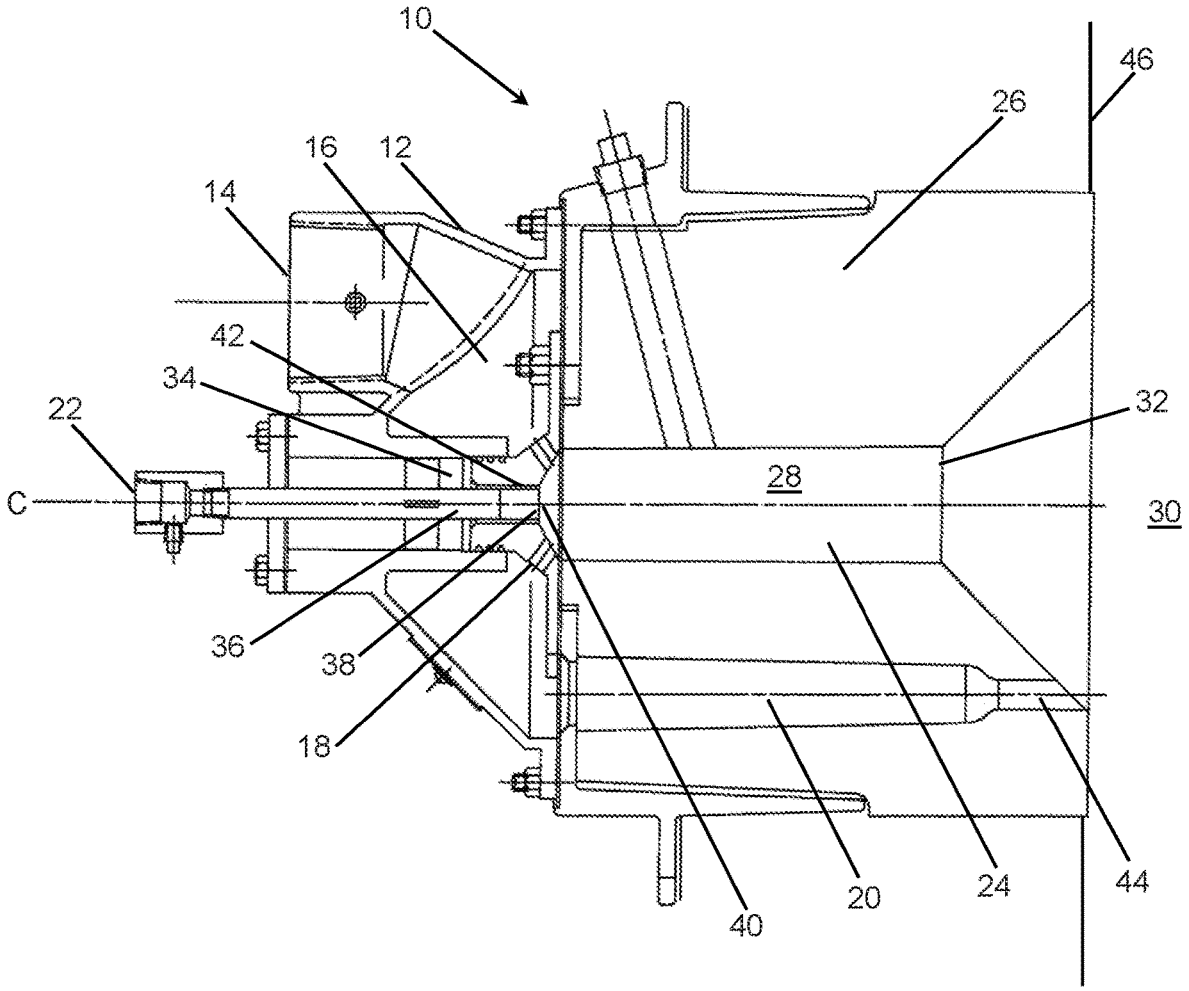
FIG. 1 is a side cross-sectional view of a combustion burner according to the present invention.
Figure 2:
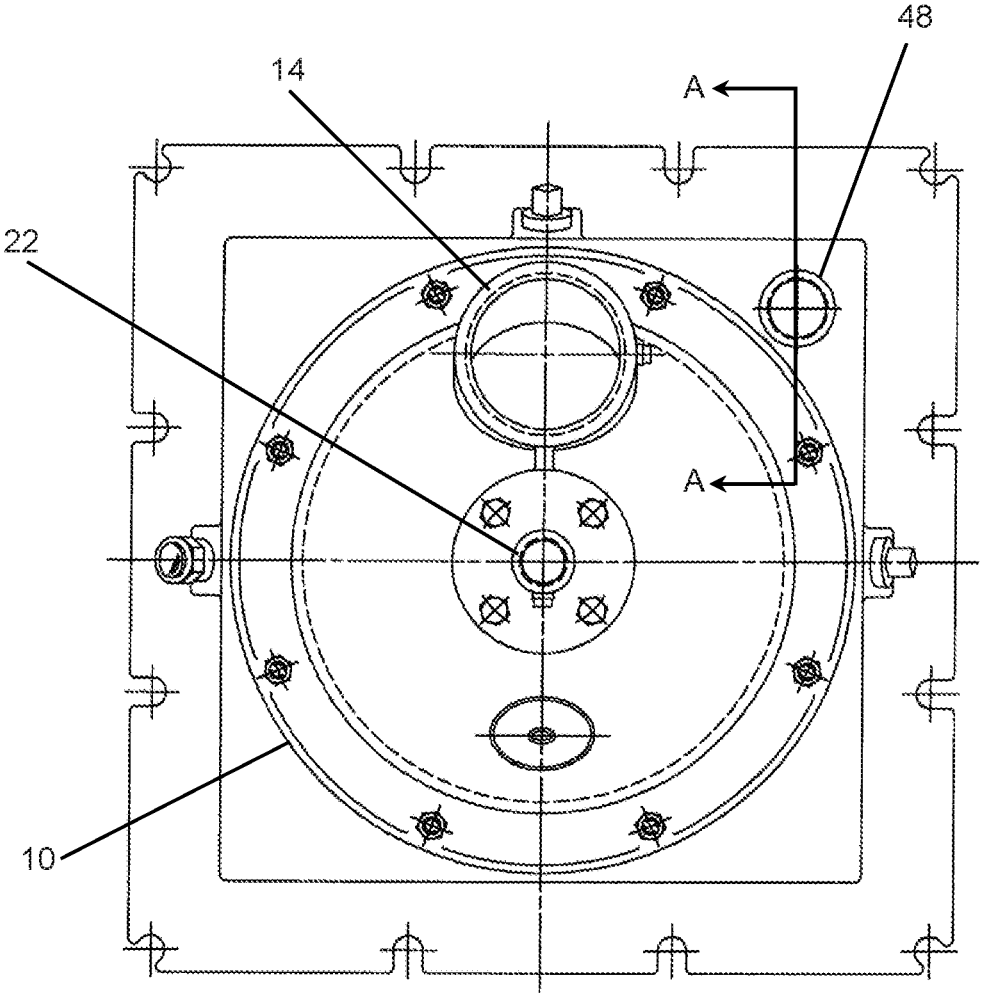
FIG. 2 is a back view of a combustion system according to the present invention.
Figure 3:
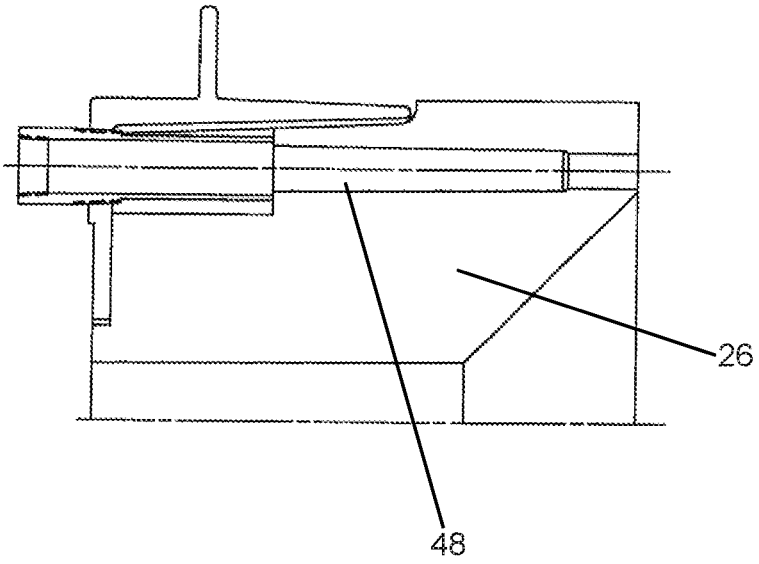
FIG. 3 is a cross-section view along line A-A of FIG. 2.

The inventive combustion burner 10 as shown in FIGS. 1-3 may utilize air staging as well as the introduction of primary and secondary fuel. As shown in FIG. 1, the combustion burner 10 has a main burner body 12 that includes an air connection 14 connected to an air plenum 16 that supplies primary combustion air to at least one primary combustion air orifice 18 and secondary combustion air to at least one secondary combustion air conduit 20 and a fuel connection 22 through which primary fuel and secondary fuel are supplied to a combustion tunnel 24 defined within a port block 26 extending from the main burner body 12. The combustion tunnel 24 defines a primary combustion zone 28, and a secondary combustion zone 30 is located beyond the exit 32 of the combustion tunnel 24. Ignition occurs in the primary combustion zone 28.

Combustion air enters the air connection 14, passes into the air plenum 16 defined by the main burner body 12 and is divided into primary combustion air and secondary combustion air. The primary combustion air enters the combustion tunnel 24 through at least one primary combustion air orifice 18. The secondary combustion air passes through a least one secondary combustion air conduit 20 defined in the port block 26 and is injected into the secondary combustion zone 30. The combustion burner 10 may have from four to eight primary combustion air orifices 18. The primary combustion air may be accelerated through the primary combustion air orifice(s) 18 to achieve a velocity of at least 300 feet/second and up to 400 feet/second, for example, 300-400 feet/second. The primary combustion air may be directed in a convergent manner toward the burner centerline C and/or the primary combustion air orifice(s) 18 may be slightly offset to induce a swirl pattern to the primary combustion air. The convergence angle of the primary combustion air orifice(s) 18 with respect to the burner centerline C may be at least 30° and up to 60°, for example, 30°-60°. The swirl or offset may be as much as 0.7 times the combustion tunnel 24 diameter.

The supply fuel enters the fuel connection 22 and is divided into primary fuel and secondary fuel. The primary fuel travels along one or more primary fuel paths 34, and the secondary fuel travels along one or more secondary fuel paths 36. The primary fuel path(s) 34 may be parallel to and/or concentric with the secondary fuel path(s) 36. The primary fuel path 34 is connected to an annulus 42 defined by a burner nozzle 40. The secondary fuel path 36 is fluidly connected to a fuel orifice 38, also defined by the burner nozzle 40. The primary fuel exits the burner nozzle 40 through the annulus 42 into the combustion tunnel 24 at a low velocity, which may be less than 100 feet/second. The secondary fuel passes down the secondary fuel path 36 and exits into the combustion tunnel 24 through the fuel orifice 38 and may be accelerated to a velocity greater than 350 feet/second. The annulus 42 may have a first width and the fuel orifice 38 may have a second width, where the first width of the annulus 42 is less than the second width of the fuel orifice 38.

The velocities of the primary and the secondary fuels exiting the annulus 42 and the fuel orifice 38 of the burner nozzle 40 will depend on the velocity of the primary combustion air exiting the primary combustion air orifice(s) 18. The primary fuel exiting the annulus 42 mixes in a highly turbulent region with the primary combustion air exiting the primary combustion air orifice(s) 18, creating a highly reducing combustion region within the combustion tunnel 24. The secondary fuel exiting the fuel orifice 38 is accelerated to the point that there is only partial mixing of the secondary fuel with the primary combustion air and products of combustion in the primary combustion zone 28 of the combustion tunnel 24. Therefore, the profile of combustion exiting the combustion tunnel 24 is more oxidizing toward the perimeter of the combustion tunnel 24 and more reducing along the burner centerline C.

The secondary combustion air passes through the secondary combustion air conduit(s) 20 and the secondary combustion air jet(s) 44 at the end of the secondary combustion air conduit(s) 20. The secondary combustion air jet(s) 44 are spaced apart from the exit 32 of the combustion tunnel 24 and are in fluid communication with the secondary combustion zone 30. The secondary combustion air exits the secondary combustion air jet 44 at a velocity of at least 150 feet/second and up to 400 feet/second. The secondary combustion air jet(s) 44 may be oriented parallel or convergent to the burner centerline C. The secondary combustion air exits the secondary combustion air jet(s) 44 at the furnace wall 46 and creates a negative pressure region pulling the products of combustion from the secondary combustion zone 30 back into the secondary combustion air jet 44, highly vitiating the secondary combustion air before the secondary combustion air reaches the sub-stoichiometric ratio mixture exiting the combustion tunnel 24. The resultant combustion expansion in the primary combustion zone 28 of the combustion tunnel 24 also creates suction at the furnace wall 46 in the vicinity of the exit 32 of the combustion tunnel 24, which also induces the furnace products of combustion back to the exit 32 of the combustion tunnel 24.

The burner configuration provides vitiation in the primary and secondary combustion zones 28, 30 such that the stoichiometry of the combustion burner is oxidizing to initiate stable combustion in the secondary combustion zone 30 when the furnace temperature is below 1200° F. (649° C.). At approximately 1200° F. (649° C.), the stoichiometry may be brought to approximately 5-10% excess air with the resulting main flame stability and the secondary combustion reactions completing without the generation of free combustibles. Minor traces of CO will be apparent at furnace temperatures of 1200° F.-1400° F. (649° C.-760° C.). The primary fuel to secondary fuel volume ratio can be at least 20:80 and up to 40:60, for example, 20:80-40:60 or 22:78, while the primary combustion air to secondary combustion air volume ratio can be at least 40:60 and up to 70:30, for example, 40:60-70/30 or 50:50.

The combustion apparatus also includes at least one air jet 48 for supplying additional combustion air placed outside of the combustion zones 28, 30 of the combustion burner 10. The air jet 48 may be an integral part of the combustion burner 10, for example, provided in the port block 26 as shown in FIGS. 2 and 3, or may be a separate unit attached near the combustion burner 10. The air jet 48 may supply combustion air at high velocity, for example, 350 feet/second, and the velocity of the combustion air supply by the air jet 48 may be greater than the velocity of the combustion air supplied to the first and/or the second combustion zones 28, 30. The centerline of the air jet 48 may be parallel to and offset from the centerline of the combustion zones 28, 30.

As used herein, "furnace temperature" refers to the temperature of the atmosphere inside of the furnace that is being heated by the combustion burner. As the combustion burner(s) is fired, the furnace temperature increases, until thermal equilibrium is reached.

In operation, combustion air may be provided as primary combustion air and secondary combustion air supplied to the combustion burner or by a combination of combustion air provided to the combustion burner and combustion air provided outside of the combustion zones by the air jet. At lower furnace temperatures, additional furnace gas velocity is needed to provide temperature uniformity in the furnace. The additional gas velocity may be provided by supplying combustion air through the air jet. As the furnace temperature increases, less additional gas velocity is needed. In addition, at high temperatures, any excess combustion air that is provided must be decreased so that the level of NOx will remain low.

In the method of the present invention, the amount of combustion air provided by the air jet is decreased as the furnace temperature increases in order to provide a balance between furnace temperature uniformity and NOx production. The cNOx(3% $O_2$) is maintained below a predetermined value and may be maintained at less than 100 ppm, for example, less than 90 ppm, less than 80 ppm, less than 70 ppm, less than 60 ppm, less than 50 ppm, less than 40 ppm, or less than 30 ppm. As an example, the cNOx(3% $O_2$) may be maintained at less than 40 ppm when the combustion system is operated using natural gas as a fuel and the combustion air is not preheated, i.e., supplied at ambient temperature. When different fuels and/or preheated combustion air are used, the cNOx(3% $O_2$) may be maintained at a slightly increased level.

In order to maintain cNOx(3% $O_2$) at less than 100 ppm, 5-10% excess combustion air is provided for combustion. However, depending on the temperature of the furnace, additional excess air may be provided without exceeding 100 ppm of cNOx(3% $O_2$) generation. At furnace temperatures below 1200° F., excess air of 29% or more may be supplied by the air jet which provides a small volume of air at a high velocity to provide circulation of the gases within the furnace, while 5-10% excess air is provided through the combustion burner, for a total excess air supply of 34% or more. As the temperature is increased above 1200° F., the amount of excess air supplied through the air jet is decreased as shown, for example, in Table 1, i.e., the flow of air through the air jet is reverse-modulated with respect to furnace temperature.

TABLE 1

| Furnace Soaking Temperature (° F.) | Excess Air Supplied by the Air Jet (%) | Maximum Total Excess Air (combustion burner + air jet) (%) |
|---|---|---|
| 1400 | 20-25 | 30 |
| 1600 | 16-21 | 26 |
| 1800 | 12-17 | 22 |
| 2000 | 8-13 | 18 |
| 2200 | 4-9 | 14 |

If a combustion burner is used that does not require excess air for NOx reduction, the maximum total excess air may be provided through the air jet.

Ignition of combustion may occur with 10% excess combustion air provided to the combustion burner and no jet air.

Data for a burner assembly according to the present invention using natural gas and ambient temperature combustion air is shown graphically in FIGS. 4 and 5. As can be seen in FIGS. 4 and 5, in order to maintain cNOx(3% $O_2$) in the gases emitted from the furnace less than 40 ppm, the additional combustion air supplied by the air jet is decreased as the furnace temperature increases, i.e., an inverse linear relationship.

For a burner having the characteristics shown in Table 2 using natural gas and ambient temperature combustion air, the maximum volume of air supplied by the air jet that maintains a maximum cNOx(3% O2) emission of 40 ppm at the given temperatures is shown in Table 3.

TABLE 2

| | |
|---|---|
| Nominal Rating | 750,000 BTU/Hr. |
| Nominal Combustion Air Flow | 8,250 SCFH at approx. 18" W.C. at 100° F. |
| Nominal Natural Gas Flow | 750 SCFH at approx. 33" WC delta P at 70° F. |
| Nominal Jet Air Flow | 3,100 SCFH at approx. 20" W.C. at 100° F. |
| Igniter Cooling Air Flow (Constant) | 55 SCFH at 5" W.C. at 100° F. |

TABLE 3

| Firing Rate (of Nominal 750,000 BTU/Hr.) | Furnace Temperature (° F.) | Jet Air Flow Rate Limit (SCFH) |
|---|---|---|
| 40% | 1000 | 1385 |
| | 1200 | 1000 |
| | 1400 | 615 |
| | 1600 | 230 |
| | 1720 | 0 |
| 100% | 1000 | 3100 |
| | 1200 | 3100 |
| | 1400 | 2550 |
| | 1600 | 2000 |
| | 1800 | 1460 |
| | 2000 | 915 |
| | 2100 | 640 |

In addition, at temperatures greater than 1200° F., temperature control may be maintained by pulse firing or burner turndown. The combustion burners may be operated at a burner turndown ratio (maximum heat output/minimum heat output) of 7:1, i.e., as low as 15% of maximum firing.

Whereas particular aspects of this invention have been described above for purposes of illustration, it will be evident to those skilled in the art that numerous variations of the details of the present invention may be made without departing from the invention.

The invention claimed is:

1. A method of operating a combustion burner to heat a furnace comprising:

supplying fuel and combustion air into a combustion zone where it is ignited;

supplying additional combustion air into the atmosphere outside of the combustion zone; and measuring a temperature of the atmosphere inside the furnace, wherein the amount of additional combustion air supplied outside of the combustion zone is decreased as the temperature of the atmosphere inside the furnace increases such that the content of nitrogen oxides (NOx), as corrected for 3% $O_2$ (cNOx (3% $O_2$)), in the gases generated by combustion of the fuel and the combustion air and emitted from the furnace is maintained below a predetermined value.

2. The method of claim 1, wherein the total amount of combustion air supplied is in excess of the stoichiometric air requirement for complete combustion.

3. The method of claim 2, wherein 5-30% excess air above the stoichiometric air requirement for complete combustion is supplied.

4. The method of claim 3, wherein 4-25% excess air above the stoichiometric air requirement for complete combustion is supplied as additional combustion air into the atmosphere outside of the combustion zone.

5. The method of claim 2, wherein the amount of excess air above the stoichiometric air requirement for complete combustion that is supplied is decreased as the temperature of the atmosphere inside the furnace increases.

6. The method of claim 1, wherein, as the temperature of the atmosphere inside the furnace increases, the relationship between the amount of additional combustion air supplied outside of the combustion zone and the temperature of the atmosphere inside the furnace is inverse linear.

7. The method of claim 1, wherein the combustion zone comprises a primary combustion zone and a secondary combustion zone.

8. The method of claim 7, wherein primary fuel, secondary fuel, and primary combustion air are supplied into the primary combustion zone and secondary fuel is supplied into the secondary combustion zone.

9. The method of claim 8, wherein a velocity at which the primary fuel is supplied is less than a velocity at which the secondary fuel is supplied.

10. The method of claim 1, wherein the combustion burner comprises a port block that at least partially defines the combustion zone and the additional combustion air supplied into the atmosphere outside of the combustion zone is supplied through a passageway provided in the port block.

11. The method of claim 1, wherein the additional combustion air supplied into the atmosphere outside of the combustion zone is supplied from a separate unit that is attached near the combustion burner.

12. The method of claim 1, wherein a centerline of an air jet supplying the additional combustion air supplied outside of the combustion zone is parallel to and offset from a centerline of the combustion zone.

13. The method of claim 1, wherein the additional combustion air supplied into the atmosphere outside of the combustion zone is supplied at a higher velocity than the combustion air supplied into the combustion zone.

14. The method of claim 1, wherein predetermined value of nitrogen oxides (NOx), as corrected for 3% $O_2$ (cNOx (3% $O_2$)), in the gases generated by combustion of the fuel and the combustion air and emitted from the furnace is less than 100 ppm.

15. The method of claim 1, wherein predetermined value of nitrogen oxides (NOx), as corrected for 3% $O_2$ (cNOx (3% $O_2$)), in the gases generated by combustion of the fuel and the combustion air and emitted from the furnace is less than 40 ppm.

16. The method of claim 15, wherein the fuel is natural gas and the combustion air is supplied at ambient temperature.

* * * * *